US005788411A

United States Patent [19]

Campbell

[11] Patent Number: 5,788,411

[45] Date of Patent: Aug. 4, 1998

[54] ROLLER COMPACTED CONCRETE DAM AND METHOD OF CONSTRUCTION

[75] Inventor: David B. Campbell, West Chester, Pa.

[73] Assignee: Schnabel Engineering Associates Incorporated, Bethesda, Md.

[21] Appl. No.: 694,301

[22] Filed: Aug. 8, 1996

[51] Int. Cl.[6] ..... E02B 7/02

[52] U.S. Cl. ..... 405/107; 405/116

[58] Field of Search ..... 405/284, 286, 405/107, 108, 258, 285, 287, 116, 117

[56] References Cited

U.S. PATENT DOCUMENTS

| | | | |
|---|---|---|---|
| 4,341,491 | 7/1982 | Neumann | 405/284 X |
| 4,470,728 | 9/1984 | Broadbent | 405/284 |
| 4,607,985 | 8/1986 | Matsushita | 405/284 |
| 4,643,618 | 2/1987 | Hilfiker et al. | 405/284 X |
| 4,659,252 | 4/1987 | Sexton et al. | 405/107 X |
| 4,929,125 | 5/1990 | Hilfiker | 405/286 X |
| 4,992,005 | 2/1991 | Hilfiker | 405/286 X |
| 5,193,324 | 3/1993 | Fellows | 405/262 X |
| 5,356,242 | 10/1994 | Elmore et al. | 405/262 |

*Primary Examiner*—Dennis L. Taylor
*Attorney, Agent, or Firm*—Lalos & Keegan

[57] ABSTRACT

A roller compacted concrete (RCC) dam is formed from inverted T-shape face panels to produce a lower sloped profile and L-shape face panel to produce an upper vertical profile. The face panels have drain openings in their penetrating legs to communicate with drain fill lifts placed against the vertical rise of the face panels. RCC lifts are placed on the penetrating legs to lock the placement of these face panels. The drain openings provide terminal drainage for lift line seepage. The inverted T-shape face panel has both a protruding leg and a penetrating leg projecting into the RCC lift. The protruding leg is provided with a dowel for gripping and alignment that permits raising and lowering of the face panel and is received within a sleeve in the face panel therebelow.

24 Claims, 2 Drawing Sheets

ROLLER COMPACTED CONCRETE DAM AND METHOD OF CONSTRUCTION

FIELD OF THE INVENTION

The present invention relates to roller compacted concrete (RCC) dams and to methods for the construction of such dams using concrete panels.

BACKGROUND OF THE INVENTION

Roller compacted concrete (RCC) dams are gravity dams in common use today primarily because of the rapidity at which such a roller compacted concrete dam can be constructed resulting in desired economies. Typically, such RCC dams are formed from precast concrete face panels, conventional concrete placed in conventional formwork, and extruded concrete curbs. The precast concrete panels are flat and may be interlocking and held in place by steel anchors or ties embedded in the RCC and are limited to the forming of vertical faces. These various types of facing techniques are well known to those in the art.

While believed effective and efficient in use, the known roller compacted concrete dams of prior design suffered from various problems such as erosion, disintegration of the roller compacted concrete exposed to freeze-thaw cycles and the generation of crevices where vegetation can take root and other environmental exposures. These problems are common to most RCC dams having exposed RCC on the downstream face due in part to RCC lift line seepage that produces hydraulic erosion and exacerbates freeze-thaw cycle deterioration. It has been found that any lift line seepage of water that does occur is transmitted along the RCC lift line to erode the lift. While this seepage may be small in quantity, it can impair the appearance of the facing of the dam and promote further freeze-thaw damage.

SUMMARY OF THE INVENTION

It is the principal object of the present invention to provide an RCC dam and a method of construction for the protection of the RCC dam from hydraulic abrasion and environmental exposure.

Another object of the present invention is the provision of effective and efficient terminal drainage of RCC lift line seepage by providing drain fill lifts to be placed against the panel for permitting the moisture gathering behind the panels to pass through drain openings and out from the interior of the dam.

A further object of the present invention is the provision of gripping and aligning elements on the face panels to permit both simplified raising and lowering of the panels and the alignment of them to a proper position to form the facing of the dam.

An additional object of the present invention is the provision of a face panel having a penetrating leg upon which a lift of roller compacted concrete is spread and compacted behind the drain fill and remote from the face panel to lock the face panel in place.

The present invention has as a further object the provision of inverted T-shape face panels that are placed side by side as a set at a lower level to achieve a desired facing profile having a sloped or stepped appearance.

A yet further object of the present invention is to provide the inverted T-shape face panel with a protruding leg that may be set in place atop the vertical riser of an inverted T-shape face panel previously set in place to provide a stepped face to effectively dissipate energy when used to carry spillway flows from the reservoir over the dam to the downstream channel.

A still further object of the present invention is to provide face panels for a roller compacted concrete dam that are inverted T-shape panels to provide a sloped or stepped profile for the downstream face of the dam and L-shape panels superposed above the T-shape face panels for providing a more vertical profile for the downstream upper facing of the dam.

The present invention meets the foregoing objects by reason of the use of a face panel that may be formed from precast concrete and is used to form the facing of a roller compacted concrete dam.

The face panel may have a T-shape with a vertical riser of substantial width in relation to the vertical extent of the vertical riser. One of the legs of the T protrudes into the interior of the RCC dam and is provided with a drain opening passing through the leg to be in fluid communication with the drain fill lift positioned behind the vertical riser. This drain opening and drain fill lift receive the RCC lift line seepage and drain it away from the face panel.

The other leg of the T protrudes outwardly downstream and connects with the top of a vertical riser of the T-shape face panel positioned therebelow by means of a cooperative dowel and sleeve arrangement in these adjacent face panels. The dowel also forms a gripper that enables the face panel to be grasped and raised and lowered while also providing for the alignment of the panels as they are placed into position. The L-shape face panels are positioned above the T-shape face panels and form a vertical facing for the profile of the dam.

In the construction of the roller compacted concrete dam a first set of face panels with a vertical riser and a T-shape are placed in position utilizing the gripper or dowel for raising and lowering the panels into position. The penetrating leg points upstream into the interior of the dam while the protruding leg provides for a stepped or sloped profile of the dam and faces downstream. A drain fill lift is positioned against the vertical riser and a lift of roller compacted concrete is positioned adjacent the drain fill lift and remote from the vertical riser. Additional sets of T-shape face panels are set in place with the protruding leg atop the riser therebelow and aligned with the dowel and sleeve arrangement between the respective face panels. Additional drain fill lifts and roller compacted concrete lifts are added. Thereafter, sets of the L-shape panels are positioned with the penetrating leg of the L-shape projecting into the interior of the dam for receiving the drain fill lift and adjacent roller compacted concrete lift. The penetrating leg of both the T-shape face panels and the L-shape face panels are provided with a drain opening that fluidly communicates with the drain fill lift to drain away the lift line seepage.

THE DRAWINGS

DESCRIPTION OF THE PREFERRED EMBODIMENT

The present invention is directed to a roller compacted concrete dam as shown at 10. The water level on the upstream side of the dam is shown at 12 while the downstream direction is depicted at 14. The dam 10 is positioned on a conventional base slab 16 that may be a typical concrete slab and can for instance be made of cast-in-place concrete or a previously deposited lift of RCC or other non-yielding base. Adjacent to the base slab lifts at 16, 16 are outlets 18 for drainage of moisture accumulated and released in accordance with the structure of the dam of the present invention to be described hereinafter. The drainage outlets 18 may be comprised of troughs, pipes, stone fill or other free draining materials well known in the art. Downstream of the drainage outlets 18 is the bed 20 of the waterway in which the dam of the present invention rests. On top of the bed 20 downstream of the dam may be placed a concrete spillway apron or larger sized rocks or stones, all in the conventional manner.

Figure 1:
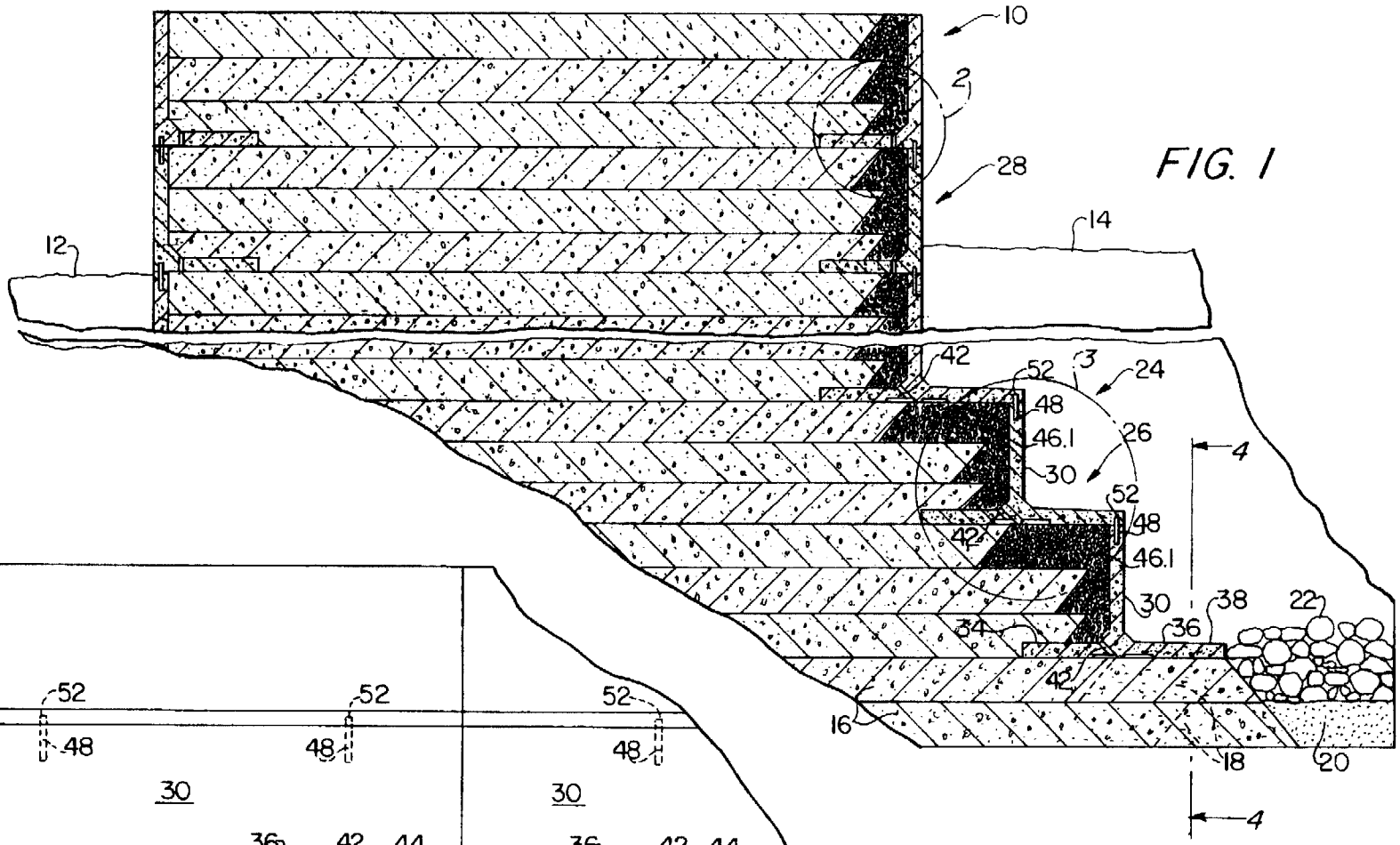
FIG. 1 is a side elevational view in partial cross-section and partly broken away of the roller compacted concrete dam of the present invention.
Figure 4:
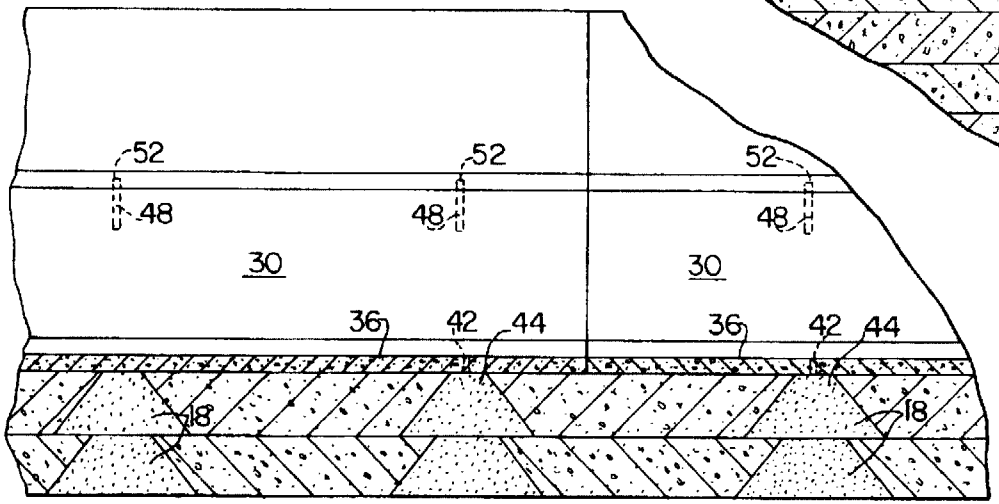
FIG. 4 is a cross-sectional view, partly broken away, taken along lines 4—4 of FIG. 1.
Figure 3:
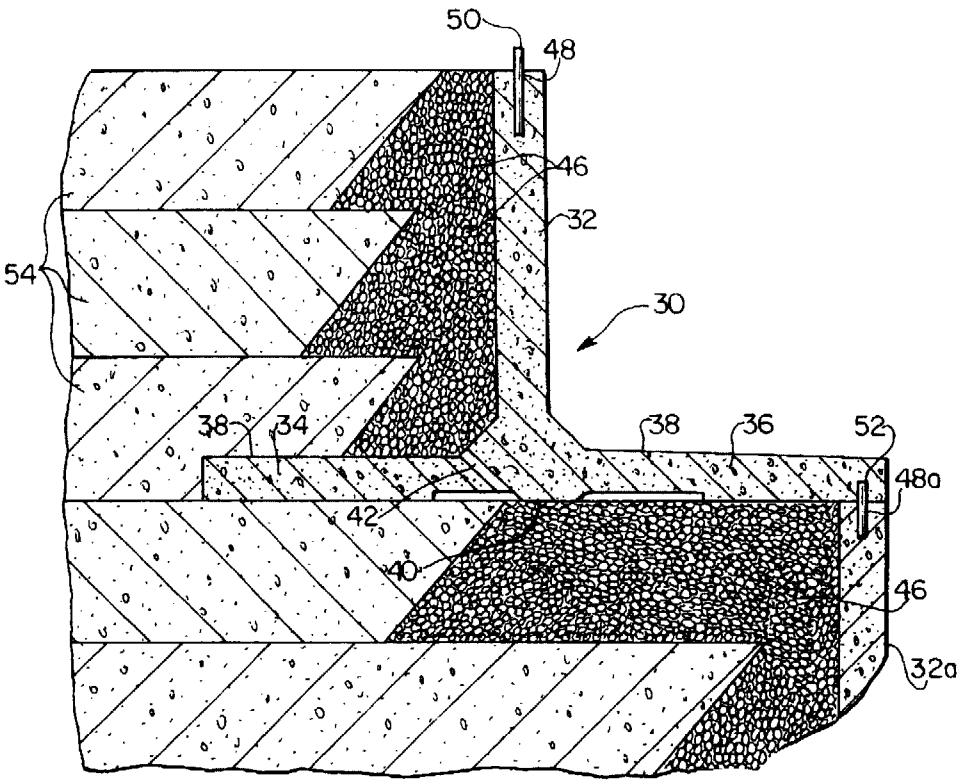
FIG. 3 is a magnified view of the section encompassed with the circle shown in FIG. 1.

The downstream facing 24 is shown in profile in FIG. 1 to have a sloped or stepped portion shown generally at 26 and a substantially vertical facing as shown at 28. As best shown in FIGS. 1 and 3, the dam is formed from an inverted T-shape panel 30 that may be made of precast concrete. The T-shape face panel 30 is composed of a vertical riser 32 and substantially horizontal legs in the form of an inwardly directed penetrating leg 34 and a protruding leg 36. Each of the top surfaces 38 of the penetrating leg 34 and the protruding leg 36 may be beveled downwardly away from the vertical riser 32 in a gentle slope that may be from about less than 1% to about 6% from the horizontal. The length of the penetrating leg and the protruding leg as measured from the center line of the riser panel may be in a ratio of less than about 0.3–1 to 1 relative to the height of the vertical riser as measured to the bottom 40 of the face panel.

As shown in FIG. 3, the T-shape face panel 30 is provided with drain openings or holes 42 that may be of size from about less than ½ inch to about 5 inches or more in diameter though preferably, the openings or holes are from 1 to 2 inches and most preferably about 1–½ inch in diameter at less than about 2 to about 20 foot centers preferably 4 to 8 foot centers and most preferably about 6 foot centers.

The drain openings or holes 42 are preferably positioned proximate to the vertical riser and angled at approximately 45°+/–40° through the leg 34 to communicate with slot 44. Slot 44 is an optional cutout at the bottom 40 of the T-shape face panel 30 and serves the purpose of assisting fluid communication from the surface 38 of the penetrating leg through the penetrating leg 34 by means of drain hole or opening 42 into the slot 44 and then into the drainage outlets 18 and away from the dam. The drainage outlets 18, slot 44 and drain opening 42 are also in direct communication with the plurality of lifts of drain fill 46 that is composed of crushed stone fill or gravel or other free draining material and placed directly behind the face panels.

The panel 30 is also provided with a unique gripping or alignment dowel 48 that is preferably of a hard metal such as steel and is embedded a substantial length into the upper portion of the vertical riser 32. This gripper or dowel protrudes as at 50 a sufficient distance to be received in complementary sleeve 52 that is formed within the outer portion of the bottom of the superposed protruding leg 36. As so constructed, the aligner dowel **48*a* of that superposed protruding leg 36 will be received into the complementary sleeve 52 positioned at the outer portion on the bottom of the protruding leg 36 as best shown in FIG. 3**.

After each individual drain fill lift 46 is positioned on top of the penetrating leg 34 an appropriately sized lift of roller compacted concrete 54 is rolled out and spread in the usual manner. As shown, the roller compacted concrete is spaced from the vertical riser 32 by reason of the drain fill lift 46. It is to be noted that it has been found preferable that the uppermost lift of drain fill 46.1 adjacent each vertical riser 32 extends a width less than about 12 inches to more than about 48 inches but preferably 24 to 30 inches and most preferably about 27 inches beyond the next lowest drain fill lift. The purpose of the greater width of the top lift of the drain fill is to accommodate the drainage from the drain openings or holes 42 immediately thereabove.

The additional RCC lifts spread and compacted behind the drain fill act to lock the penetrating panel leg 34 into place while the drain fill 46 has been found to isolate the panel 30 from most of the imposed lateral loading due to the RCC compaction operations.

As can be readily seen, when the inverted T-shape face panels 30 are placed side by side and leveled to achieve a specified panel alignment, top elevation and stem verticality, the profile of the dam will be sloped or stepped as best shown in the lower portion of FIG. 1. This slope may be varied in accordance with the length of the protruding leg 36. Typically, the desired slope horizontal:vertical is 0.7–0.8:1.0 though that slope could have a variation from less than about 2% to more than 10% of the ratio stated.

Figure 2:
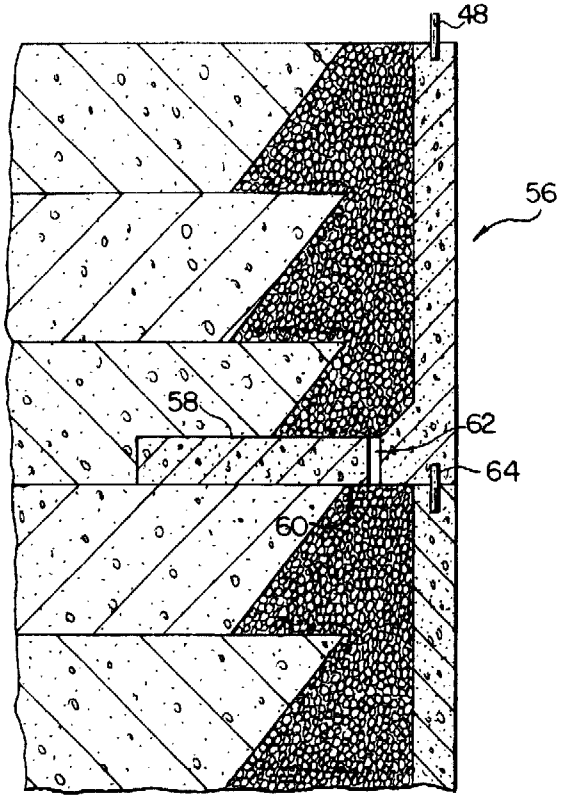
FIG. 2 is a cross-sectional view of the portion of FIG. 1, as shown in the enclosed circle, illustrating the L-shape face panel with the dowel gripper and sleeve arrangement at opposing ends.

A further aspect of the present invention should be noted after the placement of the desired sets of side by side inverted T-shape panels 30 when the dam is desired to reach a greater height with essentially little or no slope. In this instance, the face panels to be superposed above the inverted T-shape panels 30 are L-shape face panels 56 that are best shown in FIGS. 1 and 2. The structure of these panels is essentially identical to that of the inverted T-shape panel 30 except that there is no equivalent leg to the protruding leg 36 of the inverted T-shape face panel 30. Only penetrating leg 34 finds its equivalent as penetrating leg 58 and there is no need for a slot at the bottom 60 of the penetrating leg 58 because the drain hole 62 need not be angled and may be vertically disposed as shown in FIG. 2 to pass completely through penetrating leg **58*a*. The angle taken by the drain hole or opening 62** is not important.

The gripper and aligner dowel 48 is precisely the same as that previously discussed as is the receiving sleeve 52 and they act in exactly the same manner to provide both a gripping for lifting function as well as aligning the face panels as desired. It should be noted, however, that the location of the sleeve 64 of the L-shape panel 56 is beneath the center line of the vertical riser because of course there is no protruding leg as with the inverted T-shape face panel.

The L-shape panels allow simplified construction of vertical sections and easy transition from the stepped inverted T-shape panels for vertical placements above as is noted in FIG. 1. The use of the L-shape panels for forming the upstream facing of the dam does not require the drain fill lifts used for the downstream side of the dam. It has been found that both the inverted T-shape face panels and the L-shape face panels provide terminal drainage for any lift line seepage that does occur. Seepage is transmitted through the drainage network to the release points at the base of the dam. Notably, the penetrating leg of the inverted T-shape face panels and the L-shape face panels provide passive stabilization upon placement of subsequent RCC lifts. The panels are self-stabilizing during placement and do not require bracing during RCC lift placement to hold initial alignment as is common with prior art flat face panels using embedded tie rods for stability.

Another feature of the present invention is that the dowel and sleeve arrangement as shown at 48 and 52 simplifies panel alignment. Once in place, only nominal adjustments are needed to provide for panel alignment and verticality. Nominal shimming may be required to meet tight alignment specifications in unusual circumstances.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A face panel composed of concrete forming the facing of a roller compacted concrete dam having a plurality of roller compacted lifts behind said face panel comprising, said face panel having a vertical riser of substantial width in relation to the vertical extent of the vertical riser, at least one leg secured to the bottom of said vertical riser and extending substantially horizontally to said vertical riser, at least one drain opening passing through said leg, whereby water present behind the vertical riser that may exist between the roller compacted lifts may drain away from said face panel.

2. The face panel of claim 1 including, at least one gripper positioned within said vertical riser for supporting the weight of said face panel when raised.

3. The face panel of claim 1 including, at least one aligner within said vertical riser for aligning superposed face panels forming the facing of the roller compacted concrete dam.

4. The face panel of claim 1 including, at least one combined gripper and aligner positioned within said vertical riser for supporting the weight of said face panel when raised and for aligning superposed face panels forming the facing of the roller compacted concrete dam.

5. The face panel of claim 1 including, a slot positioned in and along the bottom of said leg to communicate with said drain opening to drain water through and away from said face panel.

6. The face panel of claim 3 including, a sleeve positioned at the bottom of said face panel for receiving an aligner in an adjacent face panel.

7. The face panel of claim 1 including, a penetrating leg for being embedded within the roller compacted concrete dam and a protruding leg for extending downstream of the dam.

8. The face panel of claim 7 including, a slot positioned in and along the bottom of said leg to communicate with said drain opening to drain water through and away from said face panel, and said drain opening being positioned proximate to said vertical riser.

9. The face panel of claim 1 including, a penetrating leg for being embedded within the roller compacted concrete dam and a protruding leg for extending downstream of the dam, and a slot positioned in and along the bottom of said penetrating leg to communicate with said drain opening to drain water through and away from said face panel.

10. The face panel of claim 1 including, a penetrating leg for being embedded within the roller compacted concrete dam and a protruding leg for extending downstream of the dam, a slot positioned in and along the bottom of said leg to communicate with said drain opening to drain water through and away from said face panel, and at least one combined gripper and aligner positioned within said vertical riser for supporting the weight of said face panel when raised and for aligning superposed face panels forming the facing of the roller compacted concrete dam.

11. A roller compacted concrete dam comprising, a plurality of adjacent face panels forming a facing of said dam, a plurality of lifts of roller compacted concrete behind said face panels, said face panels having a vertical riser of substantial width in relation to the vertical extent of the vertical riser, at least one leg secured to the bottom of said vertical riser and extending substantially horizontally to said vertical riser, at least one drain opening passing through said leg, and a plurality of lifts of drain fill in contact with said lifts of roller compacted concrete and positioned behind said vertical riser providing fluid communication to said drain opening for draining water through and away from said dam.

12. The roller compacted concrete dam of claim 11 including, a slot positioned in and along the bottom of said leg to communicate with said drain opening to drain water through and away from said face panel and said dam.

13. The roller compacted concrete dam of claim 11 including, said face panels having a penetrating leg for being embedded within the roller compacted concrete dam and a protruding leg for extending downstream of the dam.

14. The roller compacted concrete dam of claim 11 including, at least one gripper and aligner positioned within said vertical riser for supporting the weight of said face panel when raised and for aligning superposed face panels forming the facing of the roller compacted concrete dam, a slot positioned in and along the bottom of said leg to communicate with said drain opening to drain water through and away from said face panel, and said face panels having a penetrating leg for being embedded within the roller compacted concrete dam and a protruding leg for extending downstream of the dam.

15. A dam comprising, a plurality of adjacent face panels forming a facing of said dam, a plurality of roller compacted concrete lifts positioned behind said face panels, each said face panel having a vertical riser of substantial width in relation to the vertical extent of the vertical riser, said face panels having a penetrating leg secured to the bottom of said vertical riser and extending into said roller compacted concrete lifts, at least one face panel having a protruding leg secured to the vertical riser and projecting downstream of said dam, said protruding leg being secured to the top of the vertical riser of a face panel positioned therebelow, and whereby the downstream facing of said dam is sloped to form a stepped face.

16. The dam of claim 15 including, a plurality of lifts of drain fill positioned between said vertical riser and said roller compacted concrete.

17. The dam of claim 15 including, at least one drain opening passing through said penetrating leg.

18. The dam of claim 15 including, a plurality of lifts of drain fill positioned between said vertical riser and said roller compacted concrete, at least one drain opening passing through said penetrating leg and in fluid communication with said drain fill, and a slot positioned in and along the bottom of said penetrating leg to communicate fluidly with said drain opening to drain water through and away from said face panel and said dam.

19. The dam of claim 1 including, a plurality of lifts of drain fill positioned between said vertical riser and said roller compacted concrete, at least one drain opening passing through said penetrating leg and in fluid communication with said lift of drain fill, a slot positioned in and along the bottom of said leg to fluidly communicate with said drain opening to drain water through and away from said face panel and said dam, and at least one gripper and aligner positioned within said vertical riser for supporting the weight of said face panel when raised and for aligning superposed face panels for forming the facing of the dam.

20. The method of constructing a roller compacted concrete dam comprising, providing a first set of concrete face panels having a vertical riser forming the facing of said dam, providing said face panels with at least one leg secured to the bottom of said vertical riser and extending substantially horizontally to said vertical riser, providing at least one drain opening passing through said leg, arranging said first set of said face panels side by side, adding a drain fill lift against said vertical riser and over said leg, adding a lift of roller compacted concrete adjacent said drain fill lift and remote from said vertical riser and over said leg to lock said face panels in place, adding said lifts up to the top of said vertical riser, providing a second set of said face panels superposed upon said first set, and repeating the step of adding lifts to form the dam.

21. The method of claim 20 including, providing said face panels in said first set with an inverted T-shape including a penetrating leg for contact with the drain fill lift-and the roller compacted concrete lift and a protruding leg extending downstream, and superposing a second set of inverted T-shape face panels upon said first set to produce a stepped profile for said dam.

22. The method of claim 20 including, providing another set of face panels with an L-shape including a penetrating leg for contact with the drain fill lift and the roller compacted concrete lift, superposing said set of L-shape panels upon a set of lower face panels, and forming a substantially vertical face profile on said dam with said L-shape panels vertically spaced from said set of lower panels.

23. The method of claim 20 including, gripping and aligning said face panels by providing dowels embedded in the top of said vertical riser, and inserting said dowels in sleeves provided in the bottom of superposed face panels.

24. The method of claim 20 including, providing said panels in said first set with an inverted T-shape including a penetrating leg for contact with the drain fill lift and the roller compacted concrete lift and a protruding leg extending downstream, superposing a second set of inverted T-shape face panels upon said first set to produce a stepped profile for said dam, providing another set of face panels with an L-shape including a penetrating leg for contact with the drain fill lift and the roller compacted concrete lift, superposing said set of L-shape panels upon a set of lower face panels, forming a substantially vertical face profile on said dam with said L-shape panels vertically spaced from said lower panels, gripping and aligning said face panels by providing dowels embedded in the top of said vertical riser, and inserting said dowels in sleeves provided in the bottom of superposed face panels.

* * * * *